United States Patent [19]

Hirasawa

[11] Patent Number: 4,972,809

[45] Date of Patent: Nov. 27, 1990

[54] POWER UNIT OF INBOARD/OUTBOARD

[75] Inventor: Takeshi Hirasawa, Hamamatsu, Japan

[73] Assignee: Sanshin Kogyo Kabushiki Kaisha, Hamamatsu, Japan

[21] Appl. No.: 337,395

[22] Filed: Apr. 13, 1989

[30] Foreign Application Priority Data

Apr. 14, 1988 [JP] Japan ..... 63-090401
Apr. 14, 1988 [JP] Japan ..... 63-090402

[51] Int. Cl.[5] ..... F02B 75/26; B63H 21/30

[52] U.S. Cl. ..... 123/58 R; 123/195 HC; 440/89; 440/111

[58] Field of Search ..... 123/195 HC, 56 R, 56 AC, 123/56 BC, 58 R, 192 B, 73 AD; 440/89, 111, 900

[56] References Cited

U.S. PATENT DOCUMENTS

Re. 28,816 5/1976 Lambrecht et al. ..... 440/111
3,702,485 11/1972 Thompson ..... 440/89
4,128,083 12/1978 Bock ..... 123/56 BC
4,261,305 4/1981 Ikoma ..... 123/73 AD
4,526,002 7/1985 Bibow ..... 440/89
4,697,556 10/1987 Mondek et al. ..... 123/195 HC
4,734,071 3/1988 Zemlicka et al. ..... 440/89
4,811,717 3/1989 Nakahama ..... 123/195 HC
4,869,212 9/1989 Sverdlin ..... 123/58 R

FOREIGN PATENT DOCUMENTS 2188299 9/1987 United Kingdom ..... 440/111

*Primary Examiner*—Charles J. Myhre
*Assistant Examiner*—Weilun Lo
*Attorney, Agent, or Firm*—Ernest A. Beutler

[57] ABSTRACT

An improved propulsion unit for a watercraft embodying a reciprocating internal combustion engine having horizontally disposed cylinders so as to provide a compact assembly. The engine operates on the two-stroke principle and the exhaust manifold for the engine is disposed beneath the engine to achieve further silencing.

37 Claims, 4 Drawing Sheets

POWER UNIT OF INBOARD/OUTBOARD

BACKGROUND OF THE INVENTION

This invention relates to a power unit for a marine inboard/outboard drive and more particularly to an improved inboard mounted engine for such drives.

In one very popular form of watercraft, the watercraft is powered by an internal combustion engine that is positioned within the hull of a watercraft immediately forwardly of the transom. This power unit drives a propulsion unit that is mounted on the rear of the transom for propelling the watercraft. Frequently, the outboard transom mounted propulsion unit comprises an outboard drive unit that is supported for both steering movement about a vertically extending axis and tilt and trim movement about a horizontally extending axis in a manner similar to that of an outboard motor. Although this arrangement has a number of advantages, it also has some disadvantages as may be best seen by reference to FIG. 1, which is an illustration of a typical watercraft of the type powered in this manner.

Referring specifically to FIG. 1, there is depicted a watercraft, indicated generally by the reference numeral 11 that is comprised of a hull 12 that defines a passenger or rider's compartment 13 forwardly of a transom 14. The internal combustion engine for powering the watercraft 11 is contained within an engine compartment 15 that is positioned immediately forwardly of the transom 14 and thus protrudes into the passenger area 13. As a result, if it is desired to place seats at the rear of the passenger's compartment 13, a split seat arrangement 16 must be employed.

It is. therefore, a principal object of this invention to provide an improved, compact power unit for an inboard/outboard drive.

It is a further object of this invention to provide a compact power unit for a marine propulsion that may be positioned within the passenger's area of the hull but which will not significantly obstruct or adversely affect the seating area.

In addition to the aforenoted disadvantages, the positioning of the powering internal combustion engine in the passenger area gives rise to added noise which can be objectionable to the passengers. For example, conventional engines employed for this practice are positioned in the engine area in a generally upright condition. That is, it is the normal practice to use either inline or V type engines and these engines are installed so that the cylinders extend in a generally vertical direction. Of course, with the use of V type engines, the cylinders will be inclined to some extent. Conventionally, the exhaust manifold lies along one side of the cylinder block and the erect engine placement causes the exhaust manifold to be positioned at a relatively high level and in a generally exposed area. As a result, the noise emanations from the exhaust manifold are not at all dampened or silenced with conventional constructions.

It is, therefore, a still further object of this invention to provide an improved exhaust system layout for an internal combustion engine that will achieve natural silencing.

It is a further object of this invention to provide a power unit for a marine vessel wherein the exhaust manifold is positioned naturally in a sheltered and silenced area.

SUMMARY OF THE INVENTION

A first feature of this invention is adapted to be embodied in a propulsion unit for a watercraft having a transom and an internal combustion engine adapted to be positioned immediately forwardly of the transom and driving a propulsion device at the rear of the transom. In accordance with this feature of the invention, the engine comprises a reciprocating engine with its cylinder extending in a generally horizontal plane to provide a low silhouette for the engine.

Another feature of the invention is also adapted to be embodied in a propulsion unit for a watercraft as described in the immediately preceding paragraph. In accordance with this feature of the invention, the engine has an exhaust manifold and the engine is installed in the watercraft so that the exhaust manifold is separated from the passenger compartment by the cylinder block of the engine so that the engine provides natural silencing for the exhaust manifold.

DETAILED DESCRIPTION OF THE PREFERRED EMBODIMENT

Figure 1:
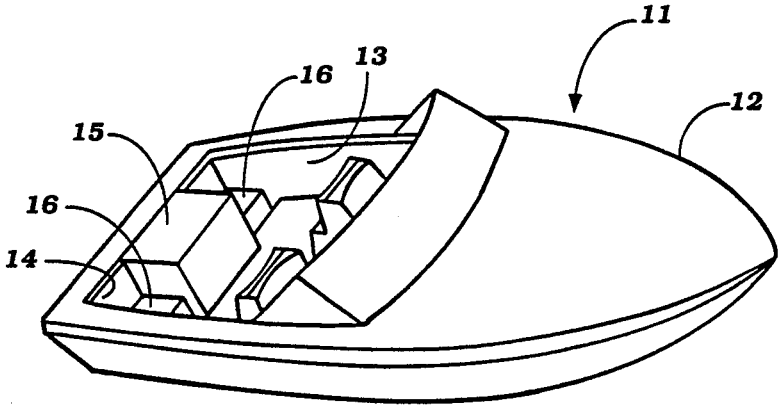
Figure 1 Prior Art
FIG. 1 is a perspective view of a watercraft constructed in accordance with the prior art.

Referring now in detail to the drawings, a watercraft powered by an internal combustion engine constructed in accordance with an embodiment of the invention is identified generally by the reference numeral 21. The watercraft 21 is comprised of a hull, indicated generally by the reference numeral 22, and which is, except as will be hereinafter noted, substantially the same construction as the prior art type of watercraft. The hull 22 includes a transom 23 with an outboard drive unit, indicate generally by the reference numeral 24, being positioned to the rear of the transom 23 for propulsion of the watercraft 21. A powering internal combustion engine, indicated generally by the reference numeral 25, and constructed in accordance with an embodiment of the invention is disposed forwardly of the transom 23 and drives the outboard drive 24 in a manner which will be described. Because of the configuration of the internal combustion engine 25, it is possible to have the passenger compartment 26 of the watercraft 21 constructed with a bench type seat 27 extending forwardly of the transom 23 and across the full width of the watercraft. The engine 25 is positioned beneath the seat 27 and above a V bottom 28 of the hull 22, in a manner as will be described.

The engine 25 is, in the illustrated embodiment, of the opposed cylinder, reciprocating two-cycle internal combustion engine. In the specific embodiment illustrated, the engine 26 is of the opposed six cylinder type. It is to be understood, however, that the invention may be utilized in conjunction with engines having other cylinder numbers and horizontally disposed cylinder banks although the invention has particular utility with opposed type engines. In addition, the invention may be utilized in conjunction with engines operating on the four-stroke principle but there are certain advantages in connection with the use of two-cycle engines, as will be described.

The engine 25 is comprised of a crankcase 29 from which a pair of cylinder blocks 31 and 32 extend. Each cylinder block 31 and 32 is provided with cylinder bores (three in the specifically described embodiment) in which pistons 33 reciprocate. The pistons 33 are connected by means of connecting rods 34 to a crankshaft 35 which is journaled for rotation within the crankcase assembly 29 about a horizontally extending axis which lies generally on the mid.plane of the hull 22.

Each cylinder block 31 and 32 is closed by means of a respective cylinder head 36 and 37 that is affixed to the respective cylinder block in a known manner. Spark plugs 38 are mounted in the cylinder heads 36 and 37 for firing a charge which is delivered to the combustion chambers of the engine 25, in a manner now to be described.

As is typical with two-cycle engine practice, the crankcase chamber 39 of the engine 25 is divided into a plurality of sealed chambers, one associated with each of the cylinder bores. A fuel/air charge is delivered to the respective chambers 39 through intake ports 41 from an intake manifold 42. A reed-type check valve 43 is positioned at each of the intake ports 41 so as to prevent reverse flow. In accordance with a feature of the invention, the intake manifold 42 is provided with a right angle curve so as to form a vertically extending face 44 to which a plurality of carburetors 45 are affixed for delivering a charge to the manifold 42. The carburetors 45 receive air from an induction device 46 that is positioned to one side of the engine and above the cylinder bank 31 so as to provide a compact assembly. The induction device 46 draws air from the area beneath the seat 27 and silences it for delivery to the engine.

The fuel/air charge that is admitted to the crankcase chambers 39 is transferred to the combustion chambers upon reciprocation of the pistons 33 through scavenge or inlet passages 47 formed in the respective cylinder blocks 31 and 32. This charge is then fired by the spark plugs 38 in a known manner.

The exhaust gases from the combustion chambers are discharged downwardly through exhaust ports 48 formed in the lower side of the cylinder blocks 31 and 32. The exhaust ports 48 communicate with generally longitudinally extending exhaust manifolds 49 that are disposed beneath the cylinder blocks 31 and 32 and, hence, the noise in the exhaust system will be insulated from the occupants of the passenger compartment 26 by the mass of the engine 25.

The manifolds 49 extend forwardly where connecting pipes 51 connect the respective manifolds 49 to a longitudinally extending muffler 52 that is disposed beneath the crankcase 29. As a result, there will be still further silencing of the exhaust gases. The muffler 52 discharges into a generally U-shaped trap section 53 that extends upwardly at the rear of the engine 25 and then discharges through the outboard drive unit 29 in a conventional manner.

A flywheel 54 is affixed to and rotates at the forward end of the crankshaft 35. The flywheel 54 may include a damping arrangement and can drive a plurality of accessories from a pulley 55 and belt 56. These accessories may include a water pump 57 and alternator 58. In addition, a starter motor 59 cooperates with starter gear teeth formed on the flywheel 54 in a known manner for starting of the engine 25.

Figure 2:
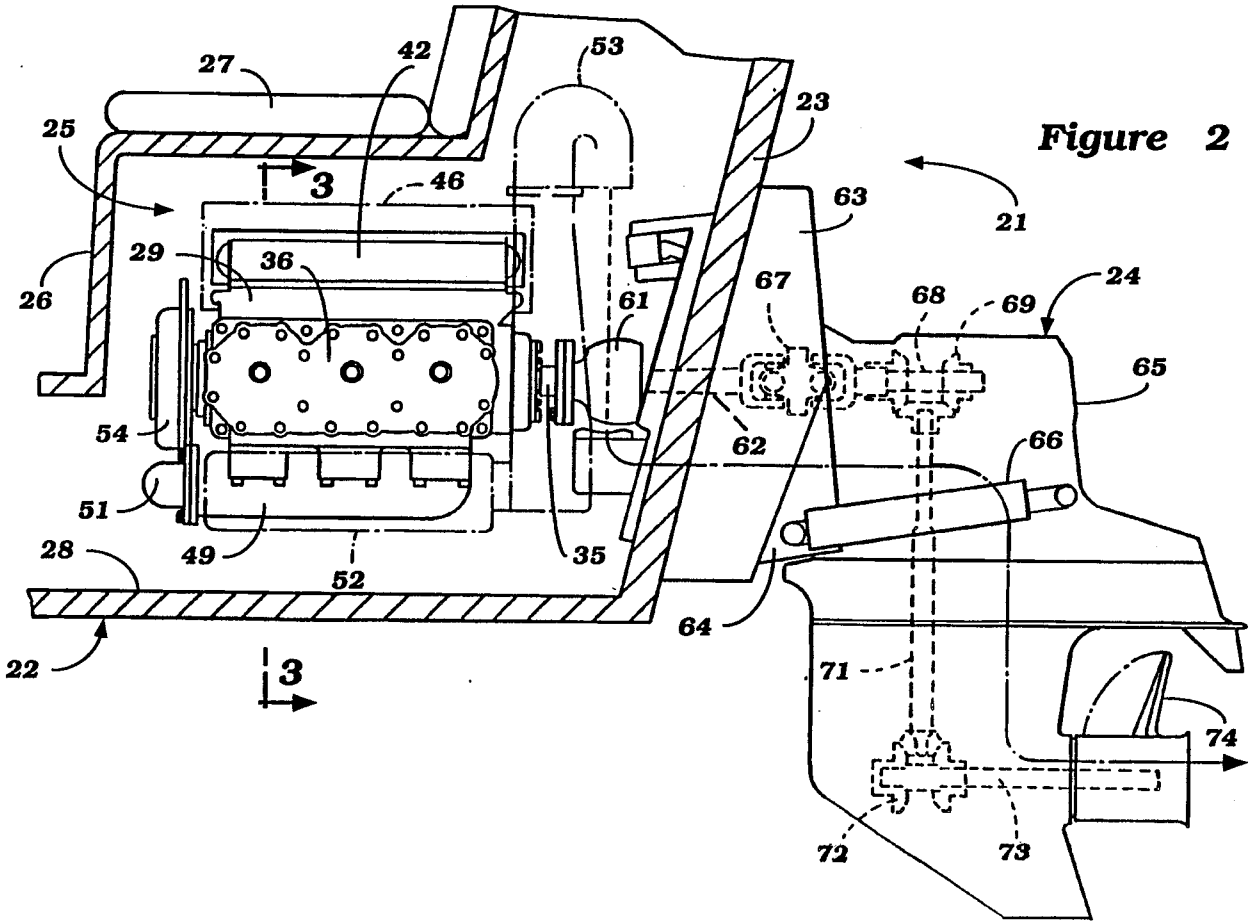
FIG. 2 is a side elevational view of a watercraft powered by an internal combustion engine constructed in accordance with an embodiment of the invention, with portions broken away and shown in section.
Figure 3:
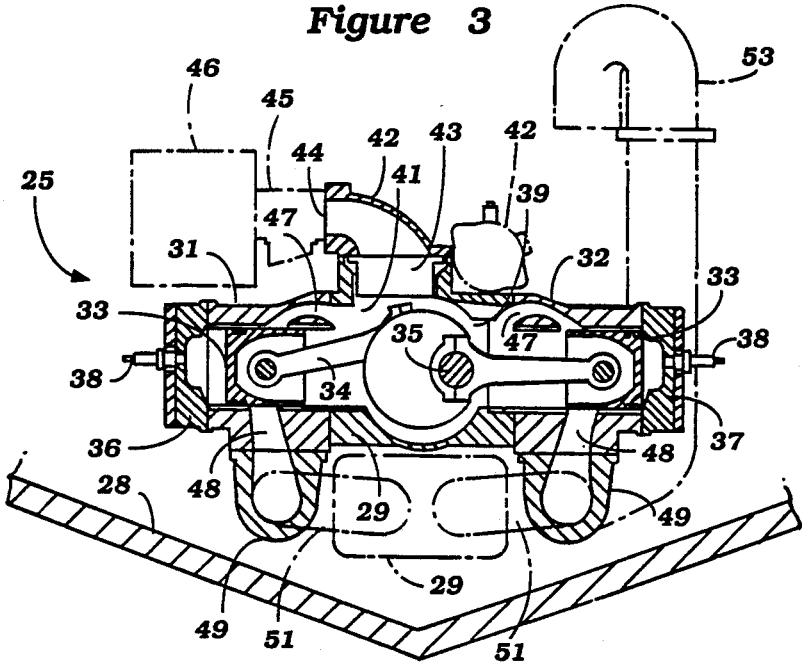
FIG. 3 is a cross-sectional view taken along the line 3—3 of FIG. 2.
Figure 4:
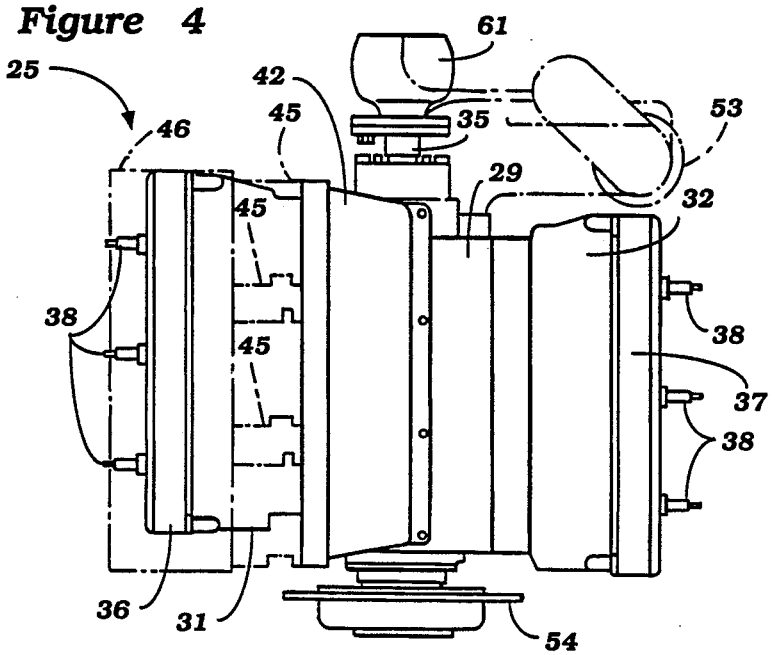
FIG. 4 is a top plan view of the power unit.
Figure 5:
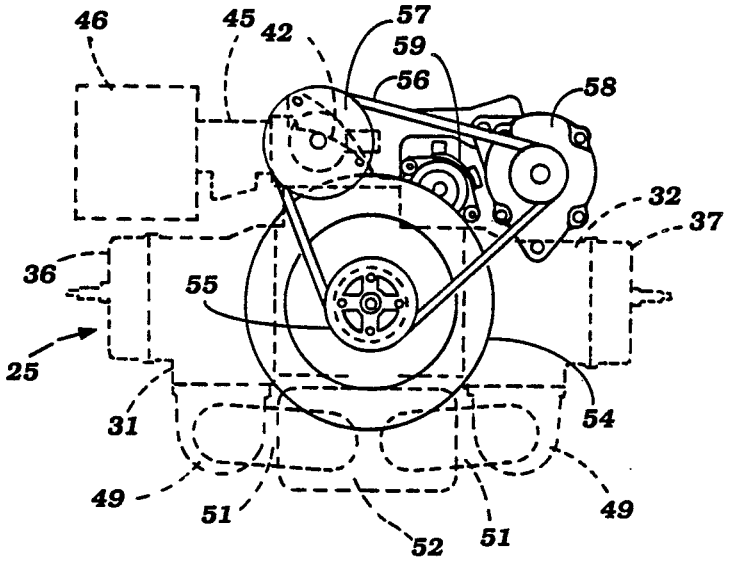
FIG. 5 is a front elevational view showing how certain of the accessories are driven.
Figure 6:
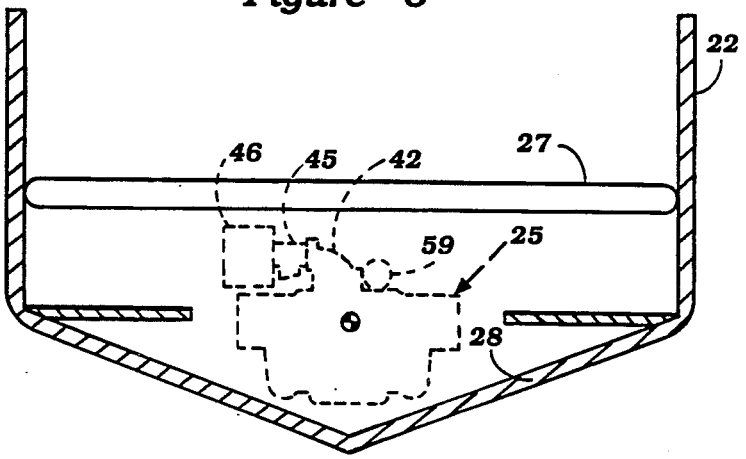
FIG. 6 is a reduced scale cross.sectional view showing how the power unit is mounted beneath the rear seat of the watercraft.

A resilient coupling 61 is affixed to the rear end of the crankshaft 35 and drives an input shaft 62 of the outboard drive unit 24 as may be best seen in FIG. 2.

The outboard drive unit 24 includes a transom bracket 63 that is affixed to the rear side of the transom 23 in a known manner and which journals a gimbal ring 64 for steering movement about a generally vertically extending axis. The outboard drive unit 24 includes an outer housing 65 that is pivotally supported by the gimbal ring 64 for tilt and trim movement, which movement is controlled by means of a pair of hydraulic cylinders 66 in a known manner.

The input shaft 62 drives a universal joint 67, which is coupled to a driving shaft 68 contained within the outboard drive housing 65. A bevel gear train 69 drives a vertically extending drive shaft 71 from the input shaft 68 and is journaled for rotation about a generally vertically extending axis within the housing 65. A conventional forward, neutral, reverse transmission 72 is provided for selectively driving a propeller shaft 73 from the lower end of the drive shaft 71 for driving a propeller 74 in selected forward and reverse directions, as is well known in this art.

It should be readily apparent from the foregoing description that the internal combustion engine 25 and its configuration and the location of the exhaust system permits a very compact assembly beneath a bench type rear seat 27 and yet is very effective in powering the watercraft. In addition, the layout of the components assist in the silencing. Although the foregoing description is that of a preferred embodiment of the invention, various changes and modifications may be made without departing from the spirit and scope of the invention, as defined by the appended claims.

I claim:

1. In a propulsion unit for a watercraft having a transom, an internal combustion engine adapted to be positioned immediately forwardly of said transom and driving a propulsion device to the rear of said transom, said propulsion device rotating about a longitudinal extending axis, the improvement comprising said engine comprising a reciprocating engine with its cylinders extending in a horizontal plane and perpendicular to the longitudinal extending axis.

2. In a propulsion unit as set forth in claim 1 wherein the engine has a plurality of horizontally extending cylinders.

3. In a propulsion unit as set forth in claim 2 wherein the engine has opposed cylinder banks in which the cylinders are formed.

4. In a propulsion unit as set forth in claim 3 wherein there are a plurality of cylinders in each bank.

5. In a propulsion unit as set forth in claim 4 wherein the engine is of the two-cycle, crankcase compression type.

6. In a propulsion unit as set forth in claim 5 further including an induction system for delivering a charge to the crankcase of the engine from above the engine.

7. In a propulsion unit as set forth in claim 6 wherein the induction system includes an intake device disposed above one of the cylinder banks.

8. In a propulsion unit as set forth in claim 7 further including an exhaust system for the engine comprising a plurality of downwardly extending exhaust ports formed in the lower sides of the cylinders.

9. In a propulsion unit as set forth in claim 8 wherein there is provided an exhaust manifold for each cylinder bank extending beneath the respective cylinder banks.

10. In a propulsion unit as set forth in claim 9 wherein the exhaust manifolds each communicate with a muffler positioned beneath the crankcase and discharging rearwardly through the transom.

11. In a propulsion unit as set forth in claim 10 further including a trap section extending from the muffler to an underwater exhaust gas discharge.

12. In a propulsion unit as set forth in claim 1 wherein each of the cylinders has a downwardly discharging exhaust port positioned beneath the respective cylinder.

13. In a propulsion unit as set forth in claim 12 wherein there are a plurality of cylinders discharging into a common exhaust manifold positioned beneath the cylinders.

14. In a propulsion unit as set forth in claim 13 wherein there are a pair of opposed cylinder banks each discharging into a respective exhaust manifold positioned beneath the respective cylinder bank.

15. In a propulsion unit as set forth in claim 14 wherein the exhaust manifolds each communicate with a muffler positioned beneath the crankcase and discharging rearwardly through the transom.

16. In a propulsion unit as set forth ]n claim 15 further including a trap section extending from the muffler to an underwater exhaust gas discharge.

17. In a propulsion unit as set forth in claim 1 wherein the propulsion unit comprises an outboard drive unit mounted to the rear of the transom and supported for steering movement about a vertically extending axis and tilt and trim movement about a horizontally disposed axis.

18. In a propulsion unit as set forth in claim 17 wherein the engine has a plurality of horizontally extending cylinders.

19. In a propulsion unit as set forth in claim 18 wherein the engine has opposed cylinder banks in which the cylinders are formed.

20. In a propulsion unit as set forth in claim 19 wherein there are a plurality of cylinders in each bank.

21. In a propulsion unit as set forth in claim 20 wherein the engine is of the two-cycle, crankcase compression type.

22. In a propulsion unit as set forth in claim 21 further including an induction system for delivering a charge to the crankcase of the engine from above the engine.

23. In a propulsion unit as set forth in claim 22 wherein the induction system includes an intake device disposed above one of the cylinder banks.

24. In a propulsion unit as set forth in claim 23 further including an exhaust system for the engine comprising a plurality of downwardly extending exhaust ports formed in the lower sides of the cylinders.

25. In a propulsion unit as set forth in claim 24 wherein there is provided an exhaust manifold for each cylinder bank extending beneath the respective cylinder banks.

26. In a propulsion unit as set forth in claim 25 wherein the exhaust manifolds each communicate with a muffler positioned beneath the crankcase and discharging rearwardly through the transom.

27. In a propulsion unit as set forth in claim 26 further including a trap section extending from the muffler to an underwater exhaust gas discharge.

28. In a propulsion unit as set forth in claim 17 wherein the cylinder has a downwardly discharging exhaust port port positioned beneath the cylinder.

29. In a propulsion unit as set forth in claim 28 wherein there are a plurality of cylinders discharging into a common exhaust manifold positioned beneath the cylinder assembly.

30. In a propulsion unit as set forth in claim 29 wherein there are a pair of opposed cylinder banks each discharging into a respective exhaust manifold positioned beneath the respective cylinder bank.

31. In a propulsion unit as set forth in claim 30 wherein the exhaust manifolds each communicate with a muffler positioned beneath the crankcase and discharging rearwardly through the transom.

32. In a propulsion unit as set forth in claim 31 further including a trap section extending from the muffler to an underwater exhaust gas discharge.

33. In a propulsion unit for a watercraft having a transom, an internal combustion engine adapted to be positioned immediately forwardly of said transom and driving a propulsion device to the rear of said transom, the improvement comprising said engine having an exhaust manifold for receiving exhaust gases from said engine, said exhaust manifold being separated from the passenger compartment by the cylinder block of said engine.

34. In a propulsion unit as set forth in claim 33 wherein the engine has opposed cylinder banks in which the cylinders are formed.

35. In a propulsion unit as set forth in claim 34 further including an exhaust system for the engine comprising a plurality of downwardly extending exhaust ports formed in the lower sides of the cylinders.

36. In a propulsion unit as set forth in claim 35 wherein there is provided an exhaust manifold for each cylinder bank extending beneath the respective cylinder banks.

37. In a propulsion unit as set forth in claim 36 wherein the exhaust manifolds each communicate with a muffler positioned beneath the crankcase and discharging rearwardly through the transom.

* * * * *